United States Patent [19]

Krogsrud

[11] Patent Number: 4,482,317

[45] Date of Patent: Oct. 13, 1984

[54] APPARATUS FOR COOLING A BODY

[75] Inventor: Harald Krogsrud, Gjettum, Norway

[73] Assignee: Elkem a/s, Oslo, Norway

[21] Appl. No.: 395,693

[22] Filed: Jul. 6, 1982

Related U.S. Application Data

[63] Continuation-in-part of Ser. No. 217,688, Dec. 18, 1980.

[30] Foreign Application Priority Data

Dec. 18, 1979 [NO] Norway ..... 794122

[51] Int. Cl.[3] ..... F27D 1/12; F27D 3/02; F28F 1/00

[52] U.S. Cl. ..... 432/238; 165/47; 165/89; 165/177; 432/234

[58] Field of Search ..... 432/234, 238; 165/47, 165/177, 89

[56] References Cited

U.S. PATENT DOCUMENTS

| | | | |
|---|---|---|---|
| 2,203,288 | 6/1940 | Willetts | 432/238 |
| 3,933,434 | 1/1976 | Matovich | 432/238 |
| 4,006,604 | 2/1977 | Seff | 165/46 |

*Primary Examiner*—John J. Camby
*Attorney, Agent, or Firm*—Lucas & Just

[57] ABSTRACT

The present invention relates to apparatus for cooling an object which is exposed to high temperatures and particularly to cooling by heat transfer to a liquid. According to the invention an internal hose is disposed in a fluid conduit. The hose is permeable to the coolant liquid which is circulated therein so that there is created a substantially stagnant fluid boundary layer between the walls of the tube and the internal hose for efficient heat transfer to the circulating fluid within the hose.

6 Claims, 4 Drawing Figures

APPARATUS FOR COOLING A BODY

This is a continuation-in-part of application Ser. No. 217,688 filed on Dec. 18, 1980.

The present invention relates to apparatus for cooling an object which is exposed to high temperatures. In particular, the present invention relates to means for cooling and transfer of heat away from the object by means of a fluid, such as water.

The typical furnace for production of ferro alloys, pig iron and carbide requires means for cooling the structural members and equipment which are disposed on or near to the furnace. Conventionally, the structural members and equipment are cooled by means of a liquid coolant, such as water. In recent years, a cooling system has been introduced which permits substantially the highest possible external temperatures of the members in the furnace environment. In such known cooling systems, steel pipes for circulating a coolant, are welded on the external side of thick steel plates forming the roof of the furnace. The internal surface temperature of the steel plates in such a structure are held to temperatures on the order of 150°-400° C. Since this temperature range is well above the condensation point of water and also well above the condensation point of sulphurous acid, the possibility of corrosion attack on the structure due to corrosive moisture in the furnace environment is substantially reduced.

Cooling systems incorporating such steel tubes welded to the furnace roof have, however, definite limitations. At atmospheric pressures, the cooling water has a boiling point of 100° C., that is, well below the surface temperature of the steel plates in the operating furnace. When the temperature of the plate increases to the point that the cooling water in the coolant tubes reaches the boiling point, the steam produced by the local boiling will block the passage of cooling water through the tube. It will be appreciated that under these circumstances, the heat will no longer be carried off and the temperature of the steel plates will rapidly rise. In order to remedy such undesirable effects it has previously been proposed to use coolants either having a higher boiling point than water and/or to pressurize the cooling liquid system. However, there are significant disadvantages to either choice. If the cooling system is based on a coolant with boiling point higher than 100° C., a heat exchanger must be used in order to reduce the temperature of the coolant before recycling it through the system. If on the other hand a high pressure cooling system is used, there are rigid safety and design requirements for proper handling of the pressure. In either system, even small amounts of leakage are intolerable.

The object of the present invention is to increase the range of temperature control of the object to be cooled without having to change the cooling medium, its pressure, composition and/or character. Accordingly, the temperature within the system may therefore vary over an extended range without overheating the cooling system. It will be appreciated that the instant invention is not limited to use in a furnace environment and may be generally used in any cooling system where there may be a chance excessive local heating of the coolant liquid.

The present invention comprises a permeable hose or tube disposed along the length of the interior of the metal conduits of a cooling system. Preferably the hose is a flexible tube of textile, filament, or other fibrous material in order to provide flexibility and compliance for reasons described below. For best results, when subjected to an internal liquid pressure the hose should behave in an elastic manner. Preferably, the external diameter of the hose substantially corresponds to the internal diameter of the metal conduit in which it is situated. The chosen material for the hose is required to be permeable to the chosen cooling liquid.

Further features and advantages of the apparatus according to the invention will be seen in the description of the figures in which.

Figure 1:
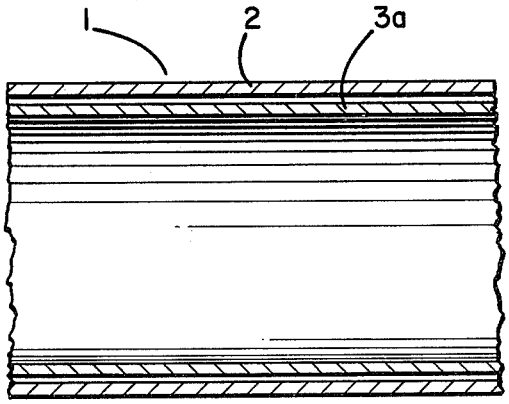
FIG. 1 is a longitudinal section of an embodiment of the invention.
Figure 2:
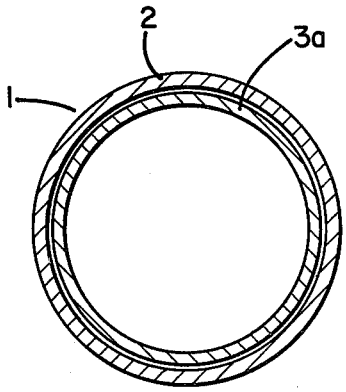
FIG. 2 is a transverse section of the embodiment of FIG. 1.

In FIGS. 1 and 2, a cooling conduit according to the invention is shown generally at 1. Metal tube or conduit 2 has axially disposed therein a flexible fiberglass hose or tube 3*a*. A conventional cooling liquid, preferably water, is circulated through the conduit 1 whenever heat is to be removed from the environment of the conduit. In accordance with the invention, the flexible fiberglass hose 3*a* is permeable to water so that water travelling axially within the hose 3*a* will initially percolate through the walls of the hose 3*a* to the interior wall of the metal tube 2 and fill the spaces between hose 3*a* and tube 2 as well as the pores of the hose.

It will be further appreciated that in accordance with the invention, the hose may be fastened at the inlet end of each tube or at both ends. The hose may further be inserted in any conventional manner, and the hose may be fastened to the tube by conventional means, for example, a connecting tube or plug. Furthermore, the walls of the conduit may be formed by the walls of an enclosed passage or channel within a metal member. It will be appreciated that the passage of the coolant liquid through the hose walls depends on several factors including the permeability thereof and the thickness of the walls.

It is believed that the advantages of the cooling apparatus according to the invention arise in accordance with the theory detailed below. It must be appreciated that there is no intent to limit the scope of the invention herein to this theory of operation which is included herein for completeness and clarity in explaining the invention.

The cooling water is circulated through the hose 3*a* at a predetermined velocity. In addition to the axial flow through hose 3*a* there will be an initial radial flow through the permeable walls which will fill any voids and pores in walls of the hose as well as the space between the tube 2 and hose 3*a*.

Because of the friction at the walls of hose 3*a*, the axial velocity of the circulating fluid will be a maximum at the center of the hose and will decrease to substantially zero velocity at the walls of the hose. Further, after the initial fill there will be substantially no further radial transport of fluid towards the walls of tube 2. Hence, in the conduit 2 according to the invention, an approximately stationary boundary layer is created in the area between the inner periphery of metal tube 2 and the inner periphery of the walls of hose 3*a*.

When the walls of tube 2 are externally heated, it has been found that temperature of the tube walls having hose 3*a* will increase more rapidly than that of a tube not having internal hose 3*a*, when exposed to the same amount of heat and for the same volume and velocity of the coolant through the tube.

For the conventional conduit not having an internal hose in accordance with the invention, the temperature of the tube wall will reach 100° C. only when the cooling liquid within the tube is boiling. Such boiling, of course, produces steam which then blocks a further passage of cooling water.

According to the present invention, the internal permeable hose 3*a* creates an internal boundary layer of cooling water between the hose and conduit wall which has substantially no axial velocity. Hence, the boundary layer of water surrounding the hose 3*a* will reach a temperature of 100° C. relatively quickly and be converted to steam. The atmosphere of steam thus created provides an enclosing steam collar around the hose. Any additional heat transfer will cause an increase in the steam temperature whereby the heat energy externally supplied will be transferred to the coolant through an atmosphere of steam. But it will be appreciated that there is no blocking of the axial flow of water through hose 3*a*.

In the preferred embodiment having a flexible elastic hose, a further significant advantage is that the expansion of the enclosing steam collar will tend to locally reduce the cross section of the hose and thereby the cross sectional area of the flow of the coolant.

The construction of the flexible hose which reduces the area of flow will locally cause an increased velocity of flow, providing thereby a temporarily increased capacity of heat transport. It will be appreciated that the wetted surface of the tube is increased in comparison to a conventional conduit without an internally arranged hose. Thus, a two-phased flow in a cooling conduit is made possible without the previously attendant disadvantage of necessarily causing blockage of the coolant flow through tube.

Figure 3:
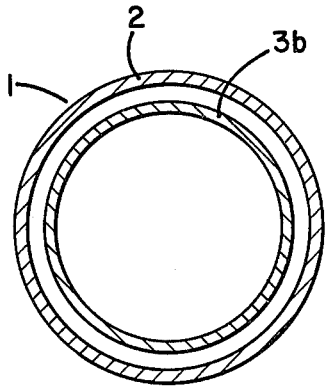
FIG. 3 is a transverse section of an embodiment of the invention having a smaller diameter hose.

FIG. 3 shows another embodiment wherein the hose 3*b* has a smaller diameter than the metal tube 2 so that a larger volume of stationary boundary layer is created.

Figure 4:
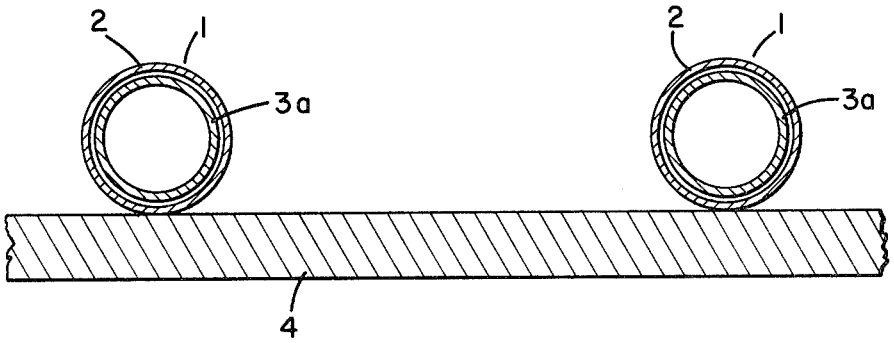
FIG. 4 is a transverse section of an embodiment of the invention on a structural member of a smelting furnace.

FIG. 4 shows two conduits 1 according to the present invention attached to a structural member 4 of a smelting furnace.

It will be understood that the claims herein are intended to cover all changes and modifications of the preferred embodiments of the invention, herein chosen for the purpose of illustration, which do not constitute departures from the spirit and scope of this invention.

What is claimed is:

1. In a smelting furnace of the type for the production of ferro alloys, pig iron, carbide and the like having structural members which are cooled by passing a coolant liquid through one or more metal pipes attached to the structural members and wherein the temperatures generated in the furnace when operating are sufficient to cause at least some of the coolant liquid to vaporize, the improvement comprising a hose means within said pipe, said hose means being of fibrous material and being permeable by the said liquid and being flexible towards and away from the internal wall of said pipe whereby the hose means contracts in response to gaseous pressure of the vaporized coolant liquid between the inside wall of said pipe and said hose means.

2. The smelting furance of claim 1 wherein said internal hose has an outer diameter which approximately corresponds to the internal diameter of said conduit.

3. The smelting furnace of claim 1 wherein said internal hose is an elastic flexible filamentous hose.

4. The smelting furnace of claim 1 wherein said flexible filamentous hose comprises a flexible fiberglass hose.

5. The smelting furnace of claim 1 wherein said flexible filamentous hose comprises a flexible textile fiber hose.

6. The smelting furnace of claim 1 or 4 wherein said coolant liquid is water and said internal hose is permeable to water.

* * * * *